US007958827B1

(12) United States Patent
Brock

(10) Patent No.: US 7,958,827 B1
(45) Date of Patent: Jun. 14, 2011

(54) NON-PYROTECHNIC EXPLOSION SIMULATION DEVICE

(75) Inventor: Nathan Randall Brock, Toccoa, GA (US)

(73) Assignee: Combat Training Solutions, Colorado Springs, CO (US)

( * ) Notice: Subject to any disclaimer, the term of this patent is extended or adjusted under 35 U.S.C. 154(b) by 418 days.

(21) Appl. No.: 12/061,949

(22) Filed: Apr. 3, 2008

Related U.S. Application Data

(60) Provisional application No. 60/921,562, filed on Apr. 3, 2007.

(51) Int. Cl.
*F42B 8/00* (2006.01)
*F42B 12/46* (2006.01)

(52) U.S. Cl. ..... 102/498; 446/401

(58) Field of Classification Search ..... 102/325, 102/328, 395, 498; 446/401
See application file for complete search history.

(56) References Cited

U.S. PATENT DOCUMENTS

| | | | | |
|---|---|---|---|---|
| 3,210,897 | A * | 10/1965 | Whittington | 52/127.4 |
| 5,069,134 | A * | 12/1991 | Pinkney | 102/368 |
| 5,996,503 | A * | 12/1999 | Woodall et al. | 102/498 |
| 7,261,041 | B2 * | 8/2007 | Brock | 102/498 |
| 2007/0169658 | A1 * | 7/2007 | Brock | 102/367 |

* cited by examiner

*Primary Examiner* — Bret Hayes
(74) *Attorney, Agent, or Firm* — Law Office of Dale B. Halling

(57) ABSTRACT

In example embodiments, a device for producing a simulated explosion that can be used with a soda bottler or other commonly available containers. A coupler couples a rupturable container to a non-pyrotechnic explosive device.

19 Claims, 10 Drawing Sheets

NON-PYROTECHNIC EXPLOSION SIMULATION DEVICE

CROSS-REFERENCE TO RELATED APPLICATIONS

This application claims priority benefit to U.S. Provisional Application No. 60/921,562 filed on Apr. 3, 2007, which is entirely incorporated herein by reference.

FIELD OF THE INVENTION

This invention relates to simulated explosive devices, and more particularly, to non-pyrotechnic explosive devices and rupturable apparatus used in connection with such devices.

BACKGROUND

There has been increased interest in simulated explosive devices by the military, law enforcement, and recreational gaming communities. For example, the increasing use of explosive devices such as mines, booby traps, and improvised explosive devices (IEDs) on the battlefield, and their potential use by terrorists, has led the military and law enforcement communities to seek simulated explosive devices to assist in training against such threats. Recreational garners, such as participants in the growing sport of paint ball and other simulated war games, also desire realistic explosion simulators that provide an exhilarating gaming experience. Thus, there is strong demand for realistic, inexpensive and reusable explosion simulator devices that also provide a high margin of safety.

A typical simulated explosion device provides a visual simulation of an explosion by discharging a marking agent, such as a liquid, solid, or powder, to cover a desired area or "kill zone". A person located in the kill zone when the marking agent is discharged will be marked with the marking agent, and classified as a "casualty," and eliminated from the training exercise or game. In addition to providing a visual cue, a simulated explosive device also preferably provides an audible report to simulate the sound generated by an explosion. The visual cue and audio cue together form a realistic simulated explosion.

In the past, pyrotechnic-based devices were commonly used to simulate an explosion. While these devices had the advantage of providing a loud report, they ultimately proved to be unsafe, complex and expensive. These pyrotechnic-based simulated explosive devices have thus been banned from most gaming activities and are disfavored by the military due to safety concerns.

Against this backdrop, non-pyrotechnic explosive devices (NPEDs) were developed to simulate explosions without the inherent dangers associated with pyrotechnic-based devices. A typical NPED utilizes a pressure chamber having a propellant, such as a $CO_2$ cylinder, to provide a force to discharge a marking agent to provide a visual simulation of an explosion.

While these NPEDs proved safer than their pyrotechnic-based predecessors, they had their own disadvantages. One drawback was the relatively weak report generated by NPEDs when compared to the report generated by a pyrotechnic-based device. This weak report contributed to an overall lack of realism for NPED generated simulations. For example, one prior art device expelled a marking agent through an outlet port in the device's housing. The outlet was sealed by a frangible cover which acted as a static barrier to the discharge of the marking agent. Pressure was released to the device to shatter the frangible seal and discharge a marking agent through the outlet port. While that device did provide a visual simulation of an explosion by discharging a marking agent, it failed to deliver a loud report. In addition, the use of a rigid frangible seal required substantial pressure to fragment the seal and discharge the marking agent. This large threshold pressure not only necessitated the use of a large and expensive compressed gas source that could produce harmful shrapnel, but the device was often inoperable at low temperatures due to the decreased volume of the cooled gas.

The prior art NPEDs were also not readily adaptable to deliver reports of different magnitudes to simulate different types of explosions. For example, to realistically simulate the explosion of a hand grenade, it may be desirable to generate a report having a first magnitude and a marking spray pattern of a first size. To simulate an IED explosion on the other hand, it may be desirable to provide a louder report and a larger spray pattern.

A recent breakthrough in the field of non-pyrotechnic explosive devices (NPEDs) is the development by Combat Training Solutions LLC of an NPED device that employs a resilient rupturable membrane, such as that described in U.S. Pat. No. 7,261,041 which is hereby incorporated by reference herein in its entirety. In an exemplary embodiment of that device, the NPED utilizes a pressure source to expand and rupture a resilient rupturable membrane. In an exemplary embodiment, pressure is released from a pressure source into a marking agent container to force a marking agent into the resilient rupturable membrane and expand the membrane to the point of rupture, thereby expelling the marking agent. This not only provides a visible simulation of an explosion, but also produces the desired loud report, thereby providing a realistic simulated explosion.

The resilient rupturable membrane of that device may be in the form of an explosion tube. Preferably at least a portion of the resilient rupturable membrane is exterior of the housing so that the membrane can expand considerably outside the container beyond its original size and rupture outside the housing to produce a loud report and expel a marking agent. This arrangement also allows the device to maintain a low profile prior to expansion of the membrane so that the device can be easily concealed.

While fit for their intended purposes, perhaps the biggest drawback of these prior art NPEDs however, is the use of special seals or other parts for successful operation. Not only can these special parts make arming the device difficult and complex, but the unavailability of such parts can effectively render the devices inoperable, resulting in unwanted and expensive downtime. This is a major concern as the special parts must be ordered, purchased, shipped, received, stocked and maintained, which can be difficult when many military training exercises or recreational gaming events occur in remote locations far from supply lines. If the supply of these specialized devices is depleted, there is no substitute readily available to allow operation of the NPED device.

SUMMARY OF THE INVENTION

The present invention alleviates the aforementioned problems, as well as others, by providing a non-pyrotechnic explosion device (NPED) that is adapted for use with a variety of different readily available rupturable containers, such as a common soda bottle. An apparatus of the present invention generates a simulated explosion that produces both a visual cue and a loud report, without necessitating the use of a specialized rupturable membrane, frangible disk, or other specialized device. The present invention also provides a NPED that is easily adapted to provide simulated explosions with desired characteristics. The present invention also provides a coupler for coupling a rupturable container to a NPED, and provides a means by which the rupturable container can be filled with marking agent prior to use with a NPED. The present invention also provides an NPED in which the rupture of the rupturable container can be tightly controlled to increase the safety factor and allow for easy and quick arming and re-arming of the device.

For purposes of teaching, and not limitation, in the exemplary embodiments discussed herein, the NPED is shown as being adapted for use with a standard soda bottle. It will be understood by one of skill in the art, however, that other containers could be used, such as, by way of example and not limitation, water bottles, milk jugs, etc.

An exemplary embodiment of a non-pyrotechnic explosive system of the present invention comprises a non-pyrotechnic explosive device, a soda bottle that serves as a rupturable container, and a coupler for coupling the rupturable container to the device. A first exemplary embodiment of a non-pyrotechnic explosive device of the present invention may include a pressure chamber and an actuator adapted to release a propellant, such as a compressed gas, fluid, or the like, from the pressure chamber. The apparatus may be arranged so that activation of the actuator allows the propellant in the pressure chamber to be released into the rupturable container which increases the pressure in the rupturable container sufficiently to rupture the container and generate a loud report. The term "coupled" as used herein means that there is a flow path between two objects, such as a path for the flow of propellant and a marking agent, and does not necessarily mean that the objects are physically attached to one another. For example, a first and second component may be coupled to one another when a flow path extends between the components even though a third component physically resides between them so that the first and second components are not physically touching.

In another exemplary embodiment of the invention, the NPED may include a pressure chamber; an actuator adapted to release a propellant, such as compressed gas, from the pressure chamber; and an expulsion substance container adapted to hold a marking substance and receive propellant released from the pressure chamber. A coupler may be configured to couple a rupturable container to the NPED. The apparatus may be arranged so as to provide a flow path between the pressure chamber and the expulsion substance container and between the expulsion substance container and the rupturable container. Release of the propellant from the pressure chamber expels an expulsion substance stored within the expulsion substance container into the rupturable container and ruptures the rupturable container to discharge the marking substance and generate a loud report. As previously mentioned, for the purposes of teaching, and not limitation, in the exemplary embodiments discussed herein, the rupturable container is a standard soda bottle made of polyethylene terephthalate (PET or PETE), a thermoplastic polymer resin, but it is contemplated that other rupturable containers could be used. Thus, the use of the term "soda bottle" herein is not to be viewed as limited to a soda bottle per se, but to include other containers, such as other PET containers or similar containers.

In another aspect of the invention, a coupler is provided for releasably coupling a rupturable container to a NPED so that a flow path is established between the NPED and the rupturable container. In one exemplary embodiment, the coupler comprises an annular ring having first threads adapted for engagement with the threads of the ruputrable container, such as the threads on the neck of a soda bottle and second threads for attachment to an expulsion substance container of the NPED. A soda bottle may be attached to an NPED by screwing the bottle onto the coupler and screwing the coupler onto a cap of the expulsion substance container.

In another exemplary embodiment, an adapter coupler is provided that allows for the marking agent to be stored in the soda bottle prior to firing. The adapter coupler allows for the easy and efficient installation and removal of a soda bottle to and from the NPED, before and after firing. For example, the adapter may be coupled to a soda bottle and also coupled to an NPED to establish a flow path between the NPED and the soda bottle. After the NPED is activated to rupture the soda bottle, the remnants of the ruptured bottle may remain in the adapter. The remnants may then be removed from the NPED by simply removing the adapter containing the remnants. This is especially helpful when the remnants of the ruptured container are difficult to grasp or contain sharp edges.

The adapter may be made of material of sufficient strength to survive the rupture of the bottle so that the adapter can be easily grasped by the user after firing of the NPED and the explosion of the bottle. In one exemplary embodiment, the adapter comprises a hardened-shell cap having a first threaded opening adapted for engagement with outlet threads of an extension on the NPED and a second opening adapted for engagement with a bottle neck, the first and second openings connected by a flow pathway. The adapter may also be provided with a plug that may be used to seal the adapter. The soda bottle or other rupturable container may be prepared for use prior to coupling to an NPED by putting a marking agent into the rupturable container, coupling the adapter to the rupturable container, and inserting the plug to seal the rupturable container to prevent the marking agent from escaping the rupturable container. This allows the rupturable container to be stored and shipped with the marking agent within the bottle. In use, the plug may then be removed and the adapter coupled to the NPED so that the marking agent-filled container is coupled to the NPED for firing.

In another exemplary embodiment, a socket-type arrangement is provided in which a bottle housing is used to house the bottle. The housing may include a base having a socket to receive the neck of a soda bottle. The bottle neck may be slid into the socket and the base of the housing coupled to a NPED so that the mouth of the bottle within the socket aligns with an outlet port of the NPED. A removable end cap may be provided that can be removed for placing the bottle within the housing and replaced to enclose the bottle within the housing. The end cap prevents the bottle from being ejected from the housing when propellant is released into the bottle. The housing prevents unintentional contact with the bottle or the bottle remnants after firing and decreases the amount of shrapnel that may be launched from the device. A plurality of windows may be provided in the housing to allow expulsion of an expulsion substance and the emission of sound therethrough upon the rupture of the soda bottle.

To further control the simulated explosion and increase the safety factor, scoring means may be provided to score the bottle and weaken it at a desired point to provide for a controlled rupture and decrease the amount of shrapnel that may be ejected. In an exemplary embodiment, the scoring means is a screw mounted on the bottle housing that contacts the outer surface of the bottle when the bottle is expanded by the propellant to create a rupture point. The screw may be mounted on the housing so as to score the sidewall of the bottle when the bottle is inserted into the bottle housing. Other scoring means may also be used, such as a laser engraver, to provide weakened points at desired locations on the bottle. Because the soda bottle is not threaded into the coupler in this embodiment but merely held in a desired position by the housing, remnants from the ruptured bottle are easily removed.

The present invention thus allows a user to utilize a soda bottle or other rupturable containers with a NPED. A user may adjust the characteristics of the report generated by the device by selecting different sized or shaped rupturable containers. For example, if a louder report is desired, a user may employ a large soft drink bottle such as a two-liter bottle, whereas if a softer report is desired, the user may employ a 20 ounce bottle. It is contemplated that a user could also change the amount of propellant and the amount of marking agent used with the device to vary the characteristics of the simulated explosion.

DETAILED DESCRIPTION

Generally speaking, the systems and methods described herein are directed to apparatus for simulating an explosion. By applying what is taught herein, a rupturable container, such as a soda bottle, can be used in conjunction with a non-pyrotechnic explosive device (NPED) to generate a simulated explosion that provides both a visual cue and a loud report.

As required, exemplary embodiments of the present invention are disclosed herein. These exemplary embodiments are shown for purposes of teaching, not limitation, and it will be understood that the invention may be embodied in many various and alternative forms. The figures are not to scale and some features may be exaggerated or minimized to show details of particular elements, while related elements may have been eliminated to prevent obscuring novel aspects. Therefore, specific structural and functional details disclosed herein are not to be interpreted as limiting, but merely as a basis for the claims and as a representative basis for teaching one skilled in the art to variously employ the present invention. For purposes of teaching and not limitation, the illustrated embodiments are directed to a NPED that is adapted for use with a soda bottle but other rupturable containers could also be used.

Figure 1A:
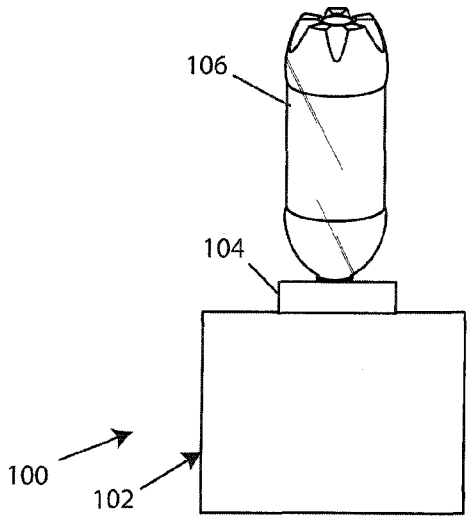
FIGS. 1A-1B show a non-pyrotechnic explosive system in accord with an exemplary embodiment of the invention.
Figure 1B:
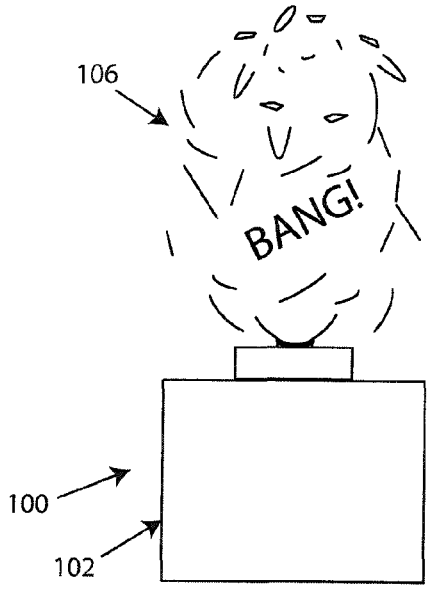

Referring now to the drawings, wherein like numerals represent like elements throughout, FIG. 1A shows a non-pyrotechnic explosive system (NPES) 100 in accordance with an exemplary embodiment of the invention which includes a non-pyrotechnic explosive device (NPED) 102, a coupler 104, and a rupturable container in the form of a soda bottle 106 that is coupled to the NPED 102 by the coupler 104. As shown in FIG. 1B, activation of the NPED 102 causes the rupturable container 106 to rupture and produce a loud report.

It should be noted that in the exemplary embodiments discussed herein, a soda bottle 106 made of polyethylene terphthalate (PET or PETE) is shown as the rupturable container. PET containers for soda, water, milk and other uses are ubiquitous and would make a desirable rupturable container for an NPED due to their wide availability. For example, it is estimated that over 40 billion PET bottles are made in the United States each year and over 5.6 billion 2-liter soda bottles are sold each year. With the global reach of the soft drink industry, PET bottles can be found in every corner of the world. Furthermore, empty PET bottles can be readily obtained at little or no cost, as most empty bottles are simply discarded as trash.

PET bottles are also prevalent in military installations and training facilities, where such bottles are commonly used as a source of potable water. For example, during deployment in desert climates, troops may be provided with several containers of water daily, frequently in form of PET containers. A large quantity of empty PET bottles can thus be found at most military installations, even in installations that are poorly supplied in general, as providing fluids for troops is often a top priority. If a NPED is adapted to use such PET bottles then a military installation could simply collect empty PET bottles and obtain a ready supply of containers for arming a NPED. Furthermore, the variety of different sizes of PET bottles, that are produced allow for a user to change characteristics of the simulated explosion of the NPED. Furthermore, these PET bottles are typically available at little or no extra cost as the bottles are typically provided to the troops for other purposes, such as a source of potable water.

Applicant has found that a standard 20 oz. PET soda bottle, such as those made by the major soft drink manufacturers, when put under pressure by a $CO_2$ cylinder with a sufficient rating, will rupture to generate a loud report and produce a desirable marking pattern when filled with a marking agent. As described in more detail below, scoring the bottle may produce a more controlled and consistent rupture that may be achieved at a lower pressure than a non-scored bottle.

Figure 2:
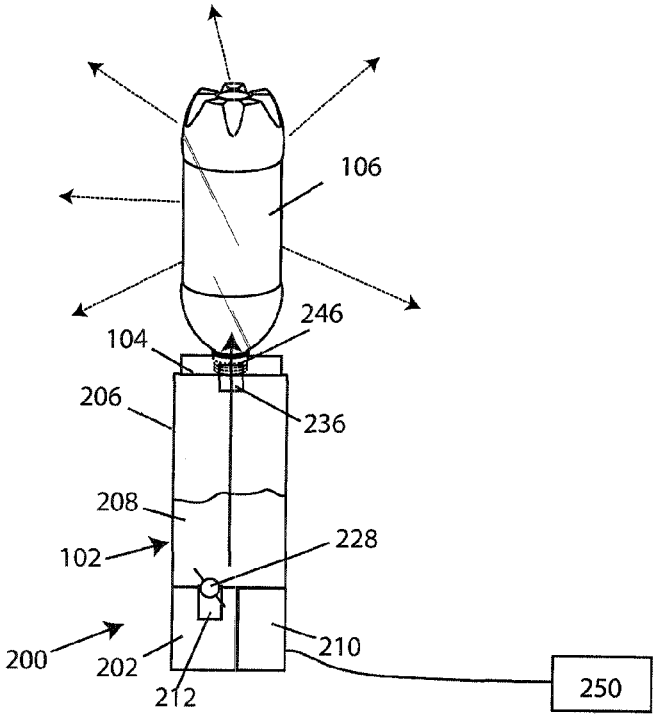
FIG. 2 shows a non-pyrotechnic explosive system in accordance with an exemplary embodiment of the invention in the form of an IED.

FIG. 2 shows another exemplary embodiment of a NPES 200 in which an NPED 102 takes the form of a simulated Improvised Explosive Device (IED) and includes a pressure chamber 202 having an outlet port 212, an expulsion substance container 206 that is coupled to the outlet port 212 of the pressure chamber 202 and configured to hold an expulsion substance 208; and an actuator 210 configured to control the release of pressure from the pressure chamber 202 into the expulsion substance container 206.

Pressure within the pressure chamber 202 may be released through the outlet port 212 by valve 228 which may be controlled by the actuator 210. The pressure chamber 202 may take a variety of forms, such as a $CO_2$ cylinder or other compressed gas container. Although shown outside the expulsion substance container 206 in FIG. 2, it is contemplated that the pressure chamber 202 could be located within the expulsion substance container 206 as discussed in more detail below in conjunction with the exemplary embodiment of FIGS. 3A-3E. Furthermore, although shown as a puncture-type $CO_2$ cylinder in the exemplary embodiment a pin-valve type actuation system may be used.

The actuator 210 provides a means for initiating the operation of the NPED 102. The actuator may take a variety of forms such as a mechanical, electrical, pressure-based device, hardline, trip wire, infrared, radio controlled, or other type device. For example, the actuator 210 may be in the form of a remote-controlled solenoid that acts to open and close the outlet port 212 by manipulating a valve 228. The actuator 210 may also include a remote control 250 communicatively coupled to the actuator 210 to provide remote actuation of the device. For example, an operator may hide from view and use the remote control 250 to activate the NPED 102 when a target is within the kill zone of the device.

A coupler 104 is provided at a top end of the expulsion substance container 206 to couple the soda bottle 106 to the NPED 102. The coupler 104 may be an annular ring with a central bore that provides a flow path between the NPED 102 and the soda bottle 106. For example, the coupler 104 may couple an outlet port 236 from the expulsion substance container 206 of the NPED 102 with a mouth 246 of the soda bottle 106. Alternatively, the coupler may simply align an outlet port 236 of the NPED 102 with the mouth 246 of the soda bottle 106 to provide a flow path.

As shown in the exemplary embodiment of FIG. 2, in operation, activation of the actuator 210 releases a compressed gas, such as $CO_2$, from the outlet port 212 of the pressure chamber 202 into the expulsion substance container 206 to force the expulsion substance 208 into the soda bottle 106 through the outlet port 236 as shown by the vertical arrow in FIG. 2 to increase the pressure within the soda bottle 106. The increased pressure within the soda bottle 106 is sufficient to rupture the bottle 106 and generate a loud report and discharge the expulsion substance 208 as shown by dashed arrows.

Figure 3A:
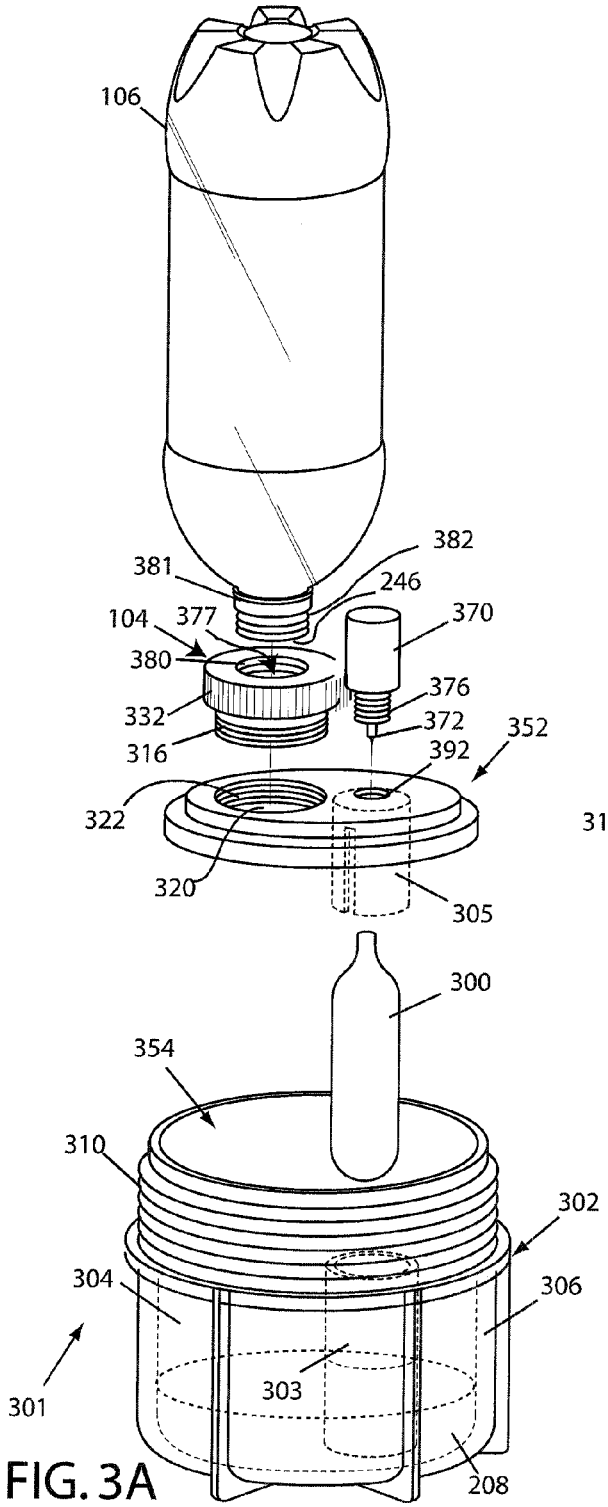
FIGS. 3A-3C show an exploded view of a non-pyrotechnic explosive system in accordance with an exemplary embodiment of the invention in the form of a land mine.
Figure 3B:
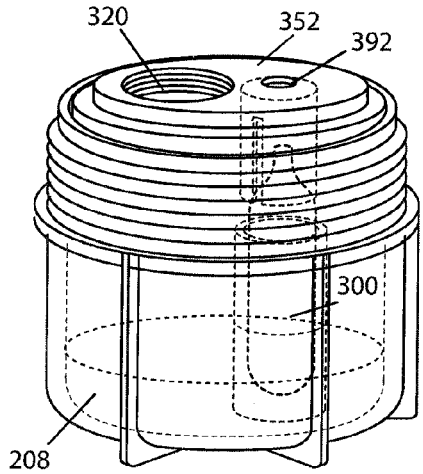
Figure 3C:
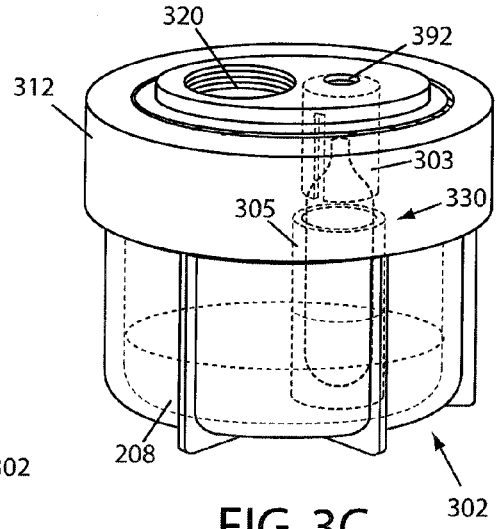

FIGS. 3A-3C show another exemplary embodiment of a NPES 301 in the form of a simulated pressure-triggered land mine. In this embodiment, an NPED 390 includes expulsion substance container 306 has a bowl-shaped body 302 with a hollow interior that defines a receiving space 304 for holding an expulsion substance 208, such as a marking agent, which could be in the form of a powder, liquid, etc. A lower portion of a cylinder holder 330 comprises an upwardly-extending open-ended tube 303 extending from the floor of the expulsion substance container 306 that is configured to receive a lower portion of a $CO_2$ cylinder 300 which serves as the pressure chamber and provides the compressed gas.

A cap 352 is provided to cover the open end 354 of the expulsion substance container 306 and enclose the cylinder 300 and the expulsion substance 208. As described in more detail below, the cap 352 is movably attached to the expulsion substance container 306 and together with a firing pin 370 acts as a pressure plate for triggering the release of pressurized gas from the $CO_2$ cylinder 300. The cap 352 has a smaller outer diameter than the inner diameter of the open top of the expulsion substance container 206 so that the cap 352 fits within the expulsion substance container 306. The $CO_2$ cylinder is placed in a bottom portion 303 of the cylinder holder 330 with the firing end facing upward (FIG. 3B). An upper portion 305 of the cylinder holder 330 in the form of a downwardly extending open-ended tube is located on the bottom of the cap 352 so that when the cap 352 is placed in the expulsion substance container 306 the upper 303 and lower 305 portions come together to enclose the $CO_2$ cylinder 300 as seen in FIG. 3B.

A retaining ring 312 may be provided to removably attach the cap 352 to the expulsion substance container 306. In this exemplary embodiment the sidewall of the expulsion substance container 306 has exterior threads 310 adapted for engagement with internal threads of the retaining ring 312.

The NPES 301 shown in the exemplary embodiment of FIGS. 3A-C is a pressure-actuated device. As mentioned above, the cap 352 fits within the expulsion substance container 306 so that the upper 305 and lower 303 portions of the cylinder holder 330 come together to form a housing for the $CO_2$ cylinder 300. The firing pin 370 is inserted into a threaded hole 392 so that a pointed end 372 extends downwardly from the bottom of the cap so that it is aligned with the $CO_2$ cylinder 300. The firing pin 370 is configured to pierce the end of $CO_2$ cylinder 300 when the cap 352 is forced downward, such as when someone steps on the pressure plate. In this embodiment a pin opening 380 includes threads for threadably engaging the threads 376 of the firing pin 370. This threaded connection allows for the firing pin 370 to be secured to the cap. When sufficient downward pressure is applied to the pressure plate 352 the firing pin 370 is forced downward so that the pointed end 372 of the firing pin 370 pierces the end of the $CO_2$ cylinder 300 to release the pressurized gas stored in the cylinder 300. The NPES 301 may be hidden or camouflaged on the ground so that when a user steps on the pressure plate 352, the pressure plate 352 moves downward forcing the firing pin 370 to pierce the cylinder 300 and release the compressed gas. As mentioned above, various alternative actuation means may be used to activate the device 301.

As shown in FIG. 3A, the pressure plate 352 also may include a threaded outlet port 320 configured to mate with a coupler 104. The coupler 104 is configured to couple the mouth 246 of the soda bottle 106 to the outlet port 320 of the expulsion substance container 306 to establish a flow path therebetween so that upon release of pressure from the $CO_2$ cylinder 300 the pressure flows from the expulsion substance container 206 into the soda bottle 106 as discussed in more detail below. For example, the coupler 104 may have external threads 316 on a lower portion that are configured for engagement with threads 322 provided at the outlet port 320 of the cap 352. The coupler 104 may have a bore 377 provided with internal threads 380 that are configured for engagement with the external threads 382 on the neck 381 of the soda bottle 106.

To couple the soda bottle 106 to the NPED 302 a user can simply screw the coupler 104 into the threaded outlet 320 of the cap 352, and screw the soda bottle 106 into the coupler 104 to obtain the arrangement shown in FIG. 3D. This arrangement provides a flow path from the expulsion substance container 306, through the outlet port 320 and the bore 377 of the coupling ring 332, into the soda bottle 106.

Upon actuation of the NPED 302, such as when the firing pin 370 punctures the $CO_2$ cylinder, pressure is released from the cylinder 300 and follows the flow path through the expulsion substance container 306 and into the soda bottle 106. The pressure forces the expulsion substance 208 from the expulsion substance container 306 into the soda bottle 106. Sufficient pressure is provided to rupture the soda bottle 106, thereby discharging the expulsion substance 208 and marking the area in vicinity of the device 301. A person within range of the device will be marked with the expulsion substance 208 and declared a "casualty."

A stop similar to the coupler 104 but without the bore 377, may be provided for sealing the outlet port 320 when the NPED 302 is not in use.

Figure 4:
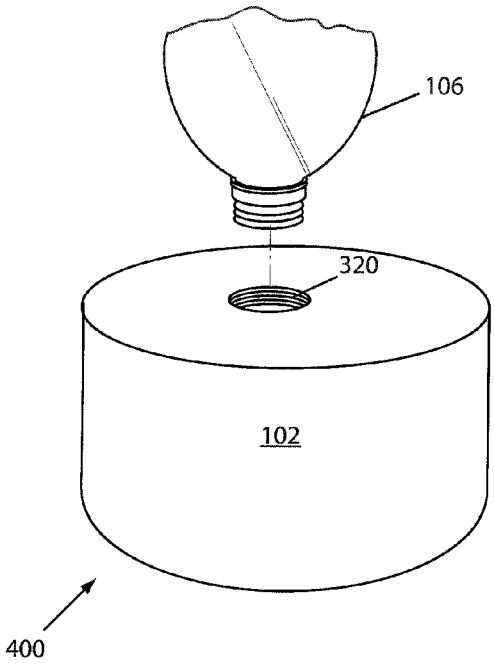
FIG. 4 shows a front view of another embodiment of a non-pyrotechnic explosive device.

Various alternative embodiments of the coupler 104 are contemplated. For example, as shown in an alternative embodiment of an MPES 400 in FIG. 4, threads may be provided directly to the NPED 302. One advantage of using the removable coupler 104 shown in FIGS. 3A-C, however, is that it allows a user to remove the coupler 104, directly in the event that remnants of a ruptured soda bottle 106 are lodged in the coupler 104 such as when the remnants are flush with the top of the NPED 302.

Figure 5:
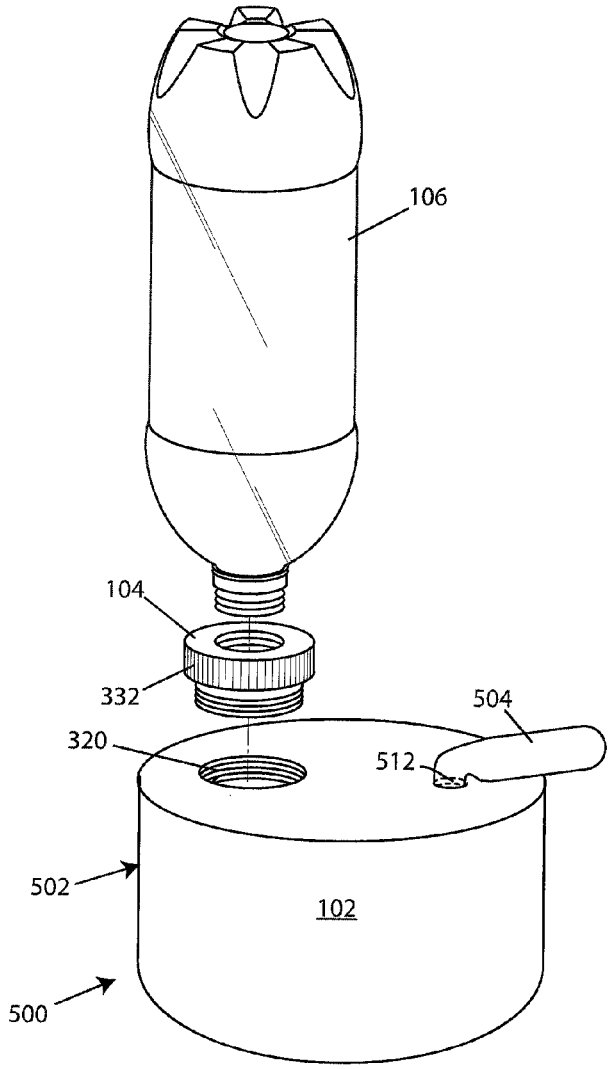
FIG. 5 shows another exemplary embodiment of a NPED.

It is also contemplated that multiple rupturable containers could be coupled to a NPED. For example, multiple couplers could be used to couple a plurality of rupturable containers, or as shown in FIG. 5, a NPES 500 may have a soda bottle 106 coupled to an NPED 302 as well as a specialized rupturable container, such as an explosion tube 504.

It is contemplated that a user could select which rupturable device to use. For example, it may be desirable to use an explosion tube 504 when the NPED will be used as a simulated subsurface landmine. In that case, a user could seal the outlet port of the coupler using a stop and use an explosion tube 504 on the other outlet port as the rupturable container, as the explosion tube 504 may be more easily concealed. If the user decides to use the NPED in such a manner that a large soda bottle or similar container is more appropriate, such as for simulating an IED, the user can plug the outlet 512 used for the explosion tube 504, remove the stop and attach the soda bottle 106.

Figure 6A:
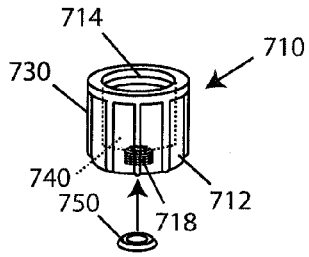
FIGS. 6A-6B show an adapter coupler in accordance with an exemplary embodiment of the invention.
Figure 6B:
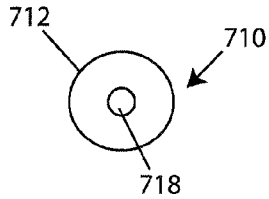
Figure 7A:
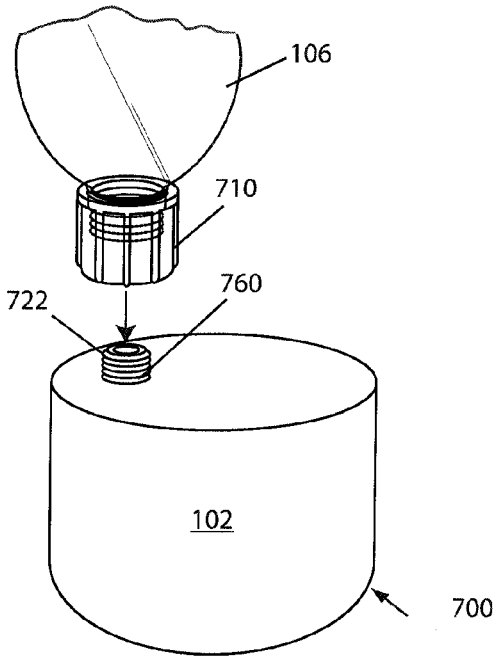
FIGS. 7A-7D show a NPED in accordance with an exemplary embodiment of the invention.
Figure 7B:
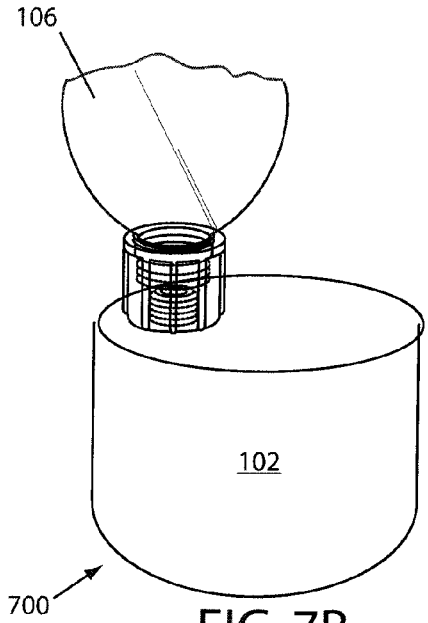

In another exemplary embodiment, shown in FIGS. 6A-6B, in lieu of an expulsion substance container a marking agent is provided within the soda bottle prior to use. An adapter coupler 710 allows for the easy installation and removal of a soda bottle 106 to and from a NPED 102. As shown in FIGS. 7A-7B, the adapter 710 may be coupled to a soda bottle 106 at a first end, and coupled to a threaded extension 722 extending from an outlet 760 of a NPED 102 at a second end to establish a flow path between the NPED 102 and the soda bottle so that the NPED 102 can rupture the soda bottle 106 as discussed above. Because the remnants 902 (FIG. 7D) of the soda bottle 106 are held by the adapter 710, the remnants 902 can be easily removed from the MPED 102 by removing the adapter 710 from the NPED 102. This is especially helpful when the remnants of the soda bottle 106 are difficult to grasp or have sharp edges.

The adapter 710 is preferably made of a material of sufficient durability to survive the rupture of the soda bottle 106 so that the adapter 710 can be easily grasped by the user after firing of the NPED. In the exemplary embodiment shown in FIG. 6A, the adapter 710 comprises a hardened-shell cap body 712 having a first threaded opening 714 adapted for engagement with the threads of a soda bottle 106 and a second threaded opening 718 for engaging a threaded outlet extension 722 of the NPED 104. The first and second threaded openings are connected by a bore 740 (FIG. 6A) that provides a flow path through the adapter 710. The adapter 710 may be provided with grips, such as raised portions 730, to assist a user in grasping the adapter 710.

Figure 7C:
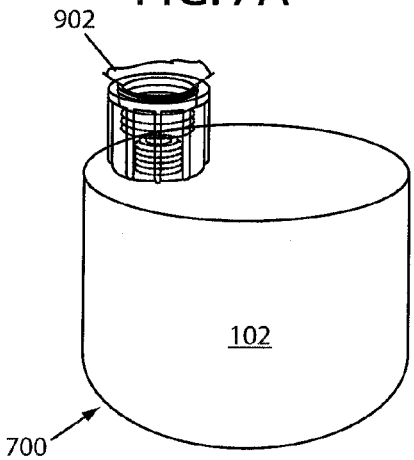
Figure 7D:
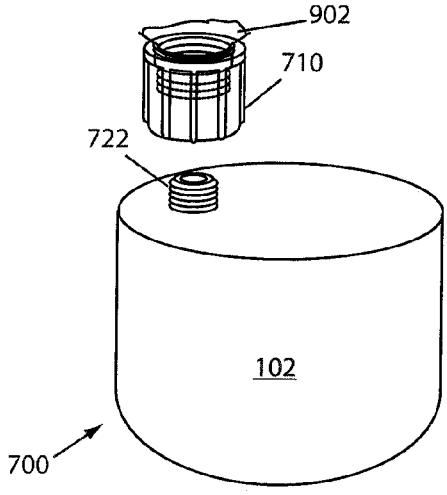

As shown in FIG. 6B the soda bottle 106 can be coupled to the NPED device 102 by screwing the adapter 710 onto an extension 722. After rupture of the container, remnants 902 of the container 106 may remain in the adapter 710 (FIG. 7C). The remnants 902 and the adapter 710 can then be removed by simply screwing the adapter 710 off the NPED 102 (FIG. 7D).

As shown in FIG. 6A, the adapter may be provided with a removable plug 750 for plugging the second threaded opening 718. Use of the adapter 710 and plug 750 allows for the soda bottle 106 to be filled with a marking agent 208 and then stored prior to use. This allows a user to preconfigure a supply of soda bottles for use, and eliminates the need to provide a marking agent 208 to an expulsion substance container 206 after each firing. For example, instead of filling an expulsion substance container 206 with an expulsion substance 208 as described above in connection with other embodiments in FIGS. 1 and 3A, the expulsion substance 208 may be put into the soda bottle 106 and the plug 750 inserted into the threaded opening 718 of the adapter 710 to seal the adapter 710 for shipment and storage. When it is time to use the soda bottle 106 for a simulated explosion, the plug 750 may be removed and the adapter 710 coupled to an NPED 102 as shown in FIGS. 7A-7B. Because the soda bottle 106 is already filled with the expulsion substance 208 no expulsion substance container is required for the NPED 102.

Turning to FIGS. 7A-7D, an NPES 700 may include an NPED 102 having a propellant, such as a compressed gas (not shown), and an actuator (not shown) to release the propellant from the NPED through an outlet port 760. An adapter 710 couples a soda bottle 106 containing an expulsion substance 208 to the outlet port 760 of the NPED 700. The outlet port 760 of the NPED 700 is aligned with the mouth 246 of the soda bottle 106 so that a flow passage is established therebetween. Activation of the actuator releases the propellant through the outlet port 760 and adapter 710 into the soda bottle 106 thereby rupturing the soda bottle 106, expelling the expulsion substance from the soda and generating a loud report.

By providing a coupler 104 that is adapted for engaging the standard threads of a soda bottle a user can easily couple different sized rupturable containers to the NPED 102. For example, a standard 20 oz. PET soda bottle has a common neck structure and threads as a standard 2 liter bottle. To adjust the report generated by the NPED 102 a user can simply use different sized off-the-shelf rupturable containers.

Figure 8A:
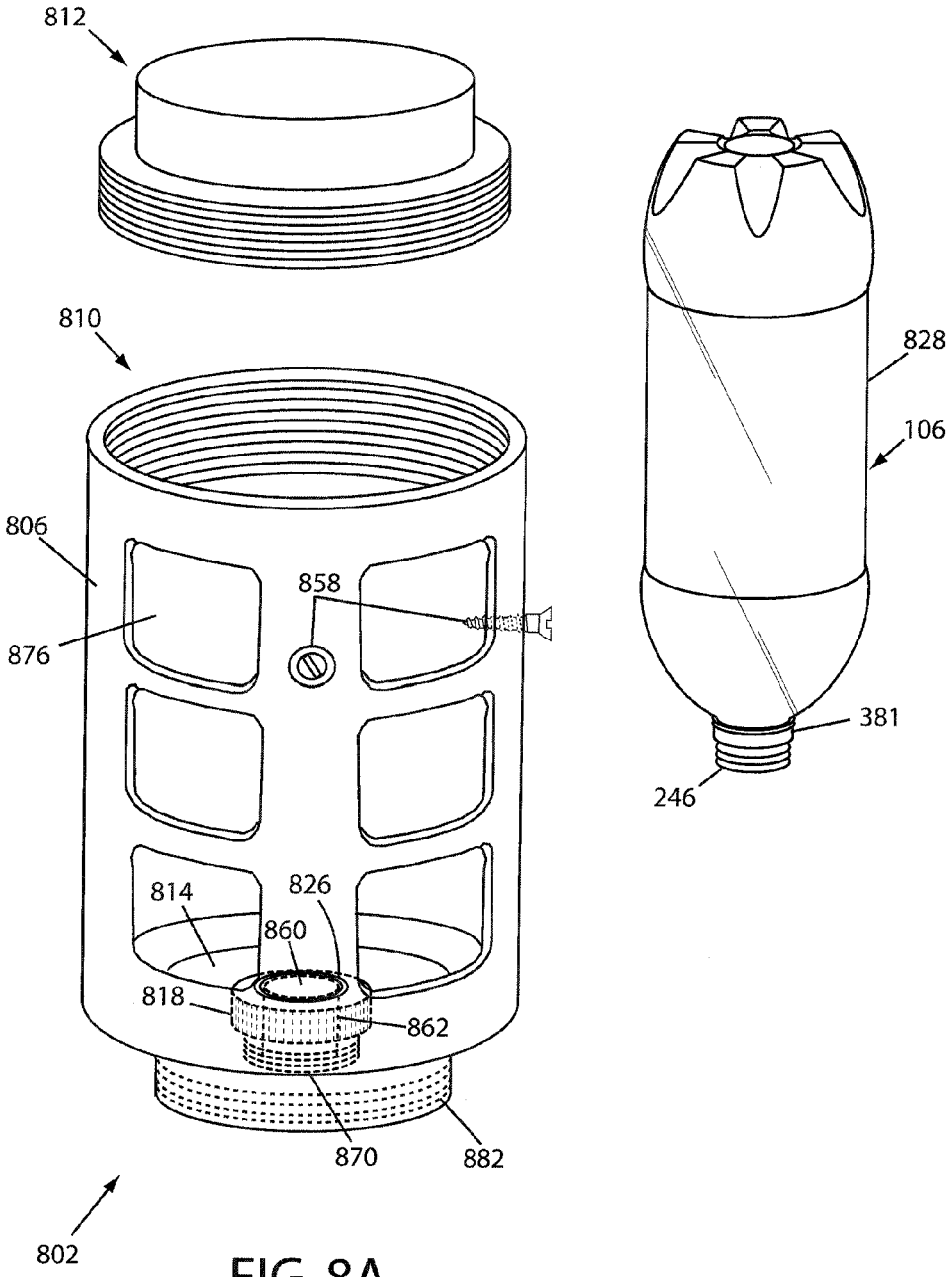
FIGS. 8A-8G show another exemplary embodiment in which a socket-type coupler is used.
Figure 8B:
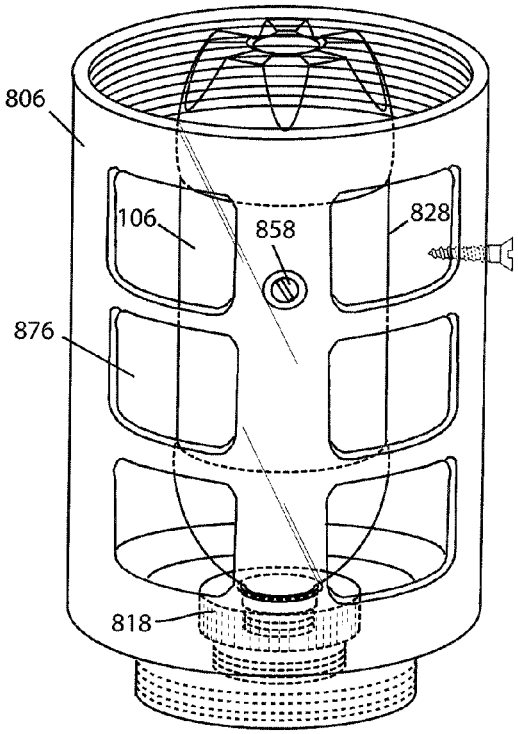
Figure 8C:
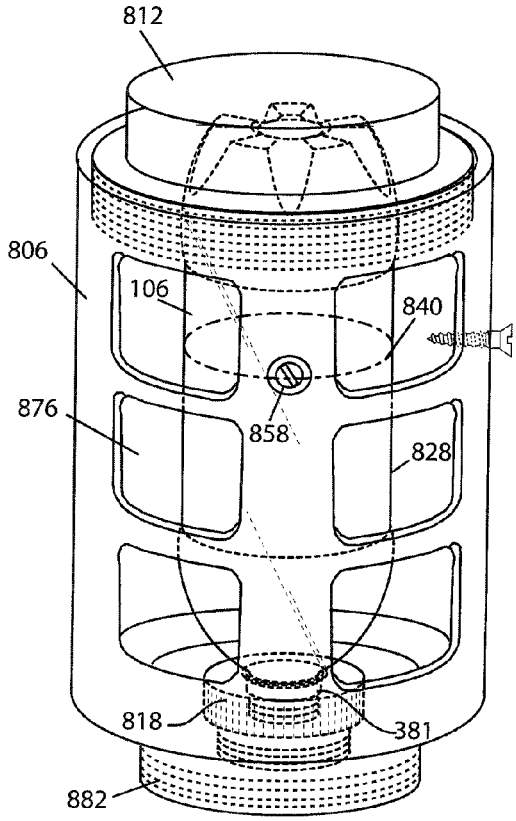
Figure 8C:
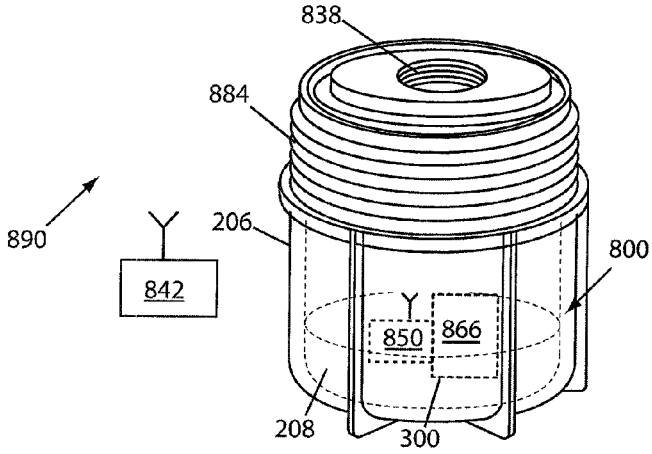
Figure 8D:
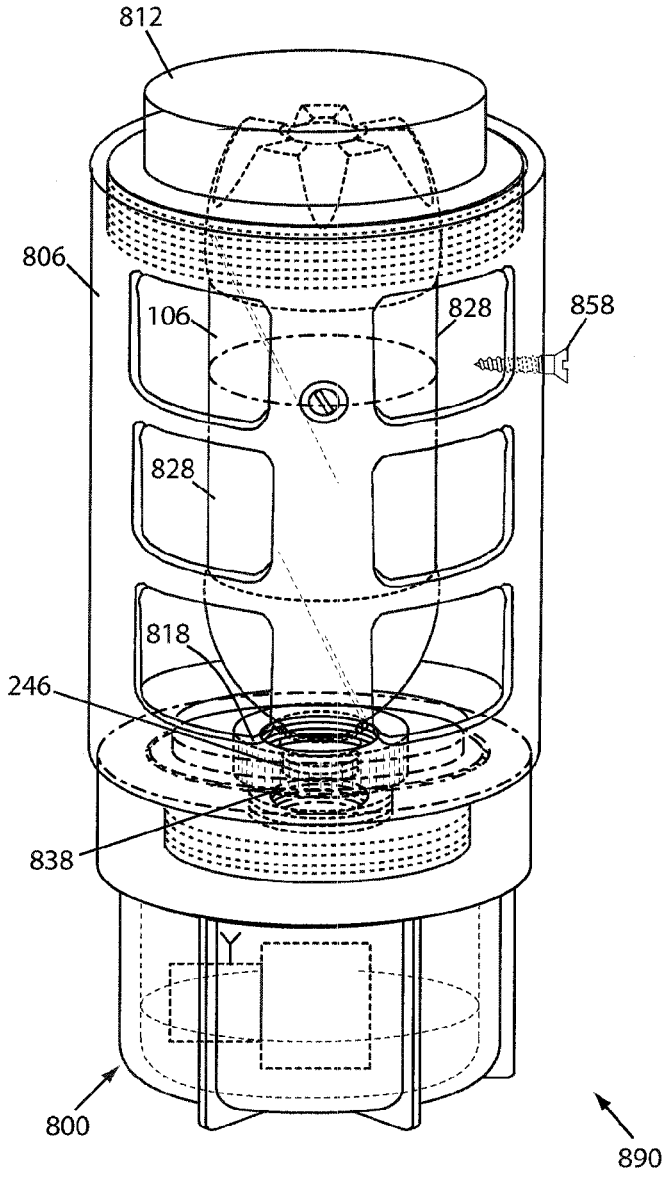

FIGS. 8A-8F show an exemplary embodiment of a socket-type coupler 802 for coupling a soda bottle 106 to an NPED 800 to form a NPES 890 (FIG. 8D). The coupler 802 may include a generally tubular housing 806 having an open end 810 for receiving a soda bottle 106, a removable end cap 812 for closing the open end 810 and enclosing the bottle 106 within the housing, a base 814 at an opposing end, and a socket 818 provided in the base 814.

The socket 818 is configured to receive the neck 381 of a soda bottle 106. For example, the socket 818 may include a bore 860 of a size to receive the neck of a soda bottle 106, the bore 860 having an open end 870. In the example embodiment, the bore 860 may have a size so that the bottle 106 is received in the socket 818. The bore 860 may have sidewalls 862 that are contoured to receive the bottle neck 381.

As described in more detail below, the socket 818 is arranged so that the mouth 246 of a soda bottle 106 faces outward at the open end 870 of the bore 860 so that the mouth 246 is aligned with an outlet port 838 (FIG. 8C) of a NPED 800, to establish a flow path for pressure and an expulsion substance from the NPED 800 to the bottle mouth 246.

The housing 806 may be configured for coupling with an NPED 800. In the exemplary embodiment of FIGS. 8A-8F, the housing 806 has inner threads 882 on the base portion 820 to threadably engage outer threads 884 on an expulsion substance container 206 of the NPED 800 (FIG. 8D). The NPED 800 shown in FIGS. 8A-8F is similar to that shown in FIG. 3A and will not be discussed in detailer herein. It should be noted, however, that a different actuation mechanism may be used in lieu of the pressure plate arrangement of FIG. 3A. For example, a remote control 842 may be used to send radio waves to an actuator 850 of the NPED to actuate the device and release a compressed gas or other propellant from a pressure chamber 866. As discussed above, the NPED 800 may include an actuator 850, a pressurized container 866, such as a $CO_2$ cylinder, an expulsion substance container 206, and an outlet port 838 through which pressure and the expulsion substance flow when actuated. A remote control 842 may be used to actuate the device.

In use, a soda bottle 106 may be inserted through the top open end 810 of the housing 806 and the neck 381 of the bottle 106 slid into the socket 818. The end cap 812 may then be tightened down to close the open end 810 and enclose the bottle 106 within the housing 806. The end cap 812 can then be tightened down to enclose the bottle within the housing. In addition, the end cap 812 may be tightened down so that it abuts the end of the bottle 106 and forces the neck 381 into the socket 818 to form a tight seal. An O-ring 826 (FIG. 8A) may be provided to assist in sealing the bottle neck 381 to the socket 818. The end cap 812 prevents the bottle from being expelled from the housing 806.

To further control the rupture of the soda bottle 106, a scoring means may be provided in the form of a screw 858 that penetrates the housing 806 so that the sharp end of the screw 858 extends into the bottle receiving area. The screw 858 provides a sharp point to initiate a rupture when the expanding sidewall of the container contacts the point of the screw 858. In one embodiment the screw 858 may also be arranged to score the bottle 106 as it is inserted into the housing to generate a vertical score line (not shown). The bottle 106 may also be scored in a horizontal direction by rotating the bottle 106 within the housing against the sharp point of the screw to generate score line 840. The coupler 802 may then be coupled to the NPED 800 as shown in FIG. 8D by engaging the threads 882 on the base of the housing 806 with the threads 884 on the NPED 800.

Figure 8E:
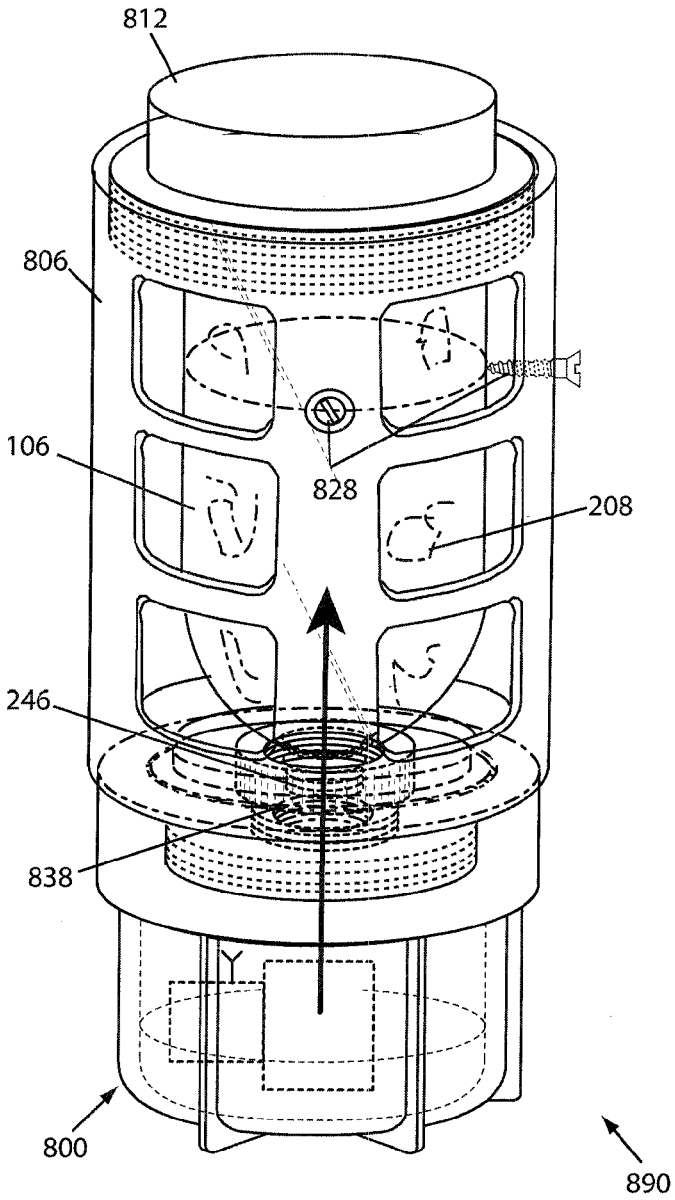

The bottle 106 is weakened along the score line 840 so as to rupture along the score line 840 when pressure is released into the bottle 106 and as shown in FIG. 8E the sidewall 828 of the bottle 106 expands to contact the point of the screw 858 thereby rupturing the bottle 106. This allows the user to tightly control the rupture of the bottle and allows the bottle to be ruptured at a lower pressure, thereby saving resources and decreasing the danger of flying shrapnel from the bottle's rupture. The scoring of the bottle, coupled with the housing windows 876, produces large remnants 888 which will not escape through the windows 876, thereby greatly increases the safety of the device. The score lines may be arranged so that the bottle ruptures into remnants 888 that are unlikely to escape through the windows 876. The screw 858 also provides a sharp point against which the bottle 106 will expand, thereby adding additional control over the rupture of the bottle. After scoring, the screw 858 may be removed or left in place to provide a sharp point which assists in rupturing the bottle 106.

Although shown as a single screw, multiple screws could be used to provide a plurality of score lines. A plurality of receiving holes may also be provided in the housing 806 for receiving screws 858 or other scoring means so that a bottle 106 can be scored in a desired manner.

The housing 806 may include a plurality of windows 876 to provide an exit through which the expulsion substance 208 may be expelled and sound may be emitted when the bottle 106 ruptures. The windows may be arranged so as to provide a desired spray pattern. The screw 858 and the windows 876 may be arranged to provide a simulated explosion with desired characteristics. For example, the windows 876 are preferably provided in the vicinity of the score line 840 so that the expulsion substance 208 is expelled in the direction of the windows 876.

Figure 8F:
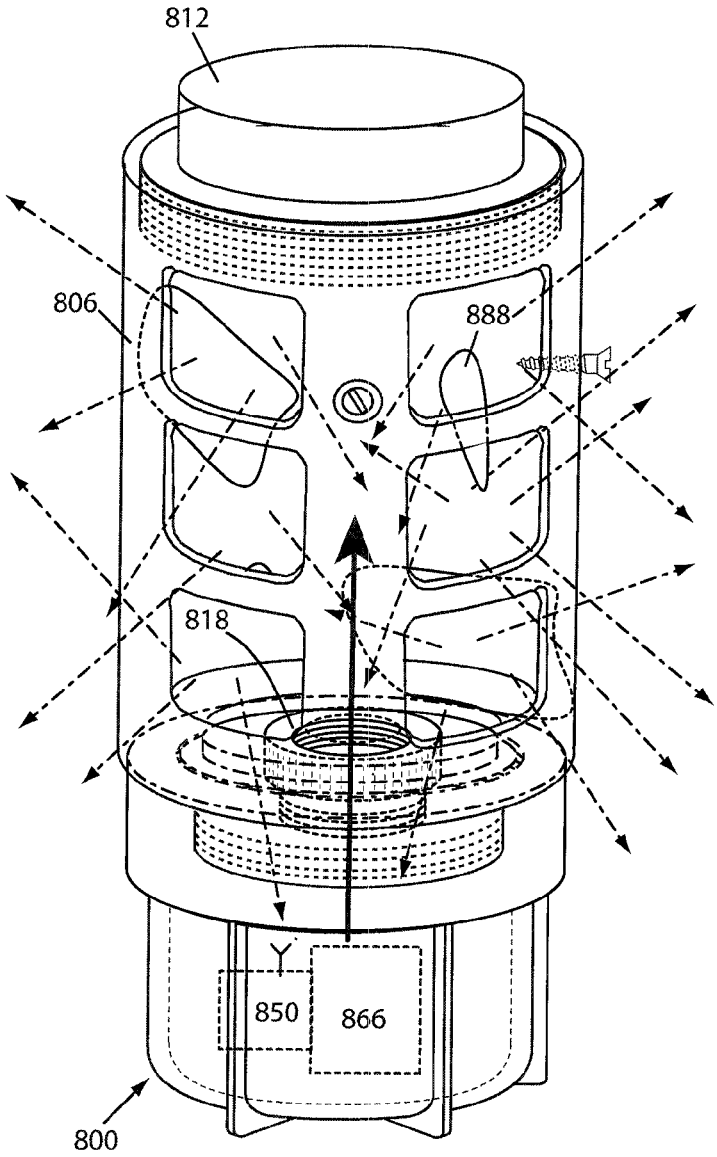
Figure 8G:
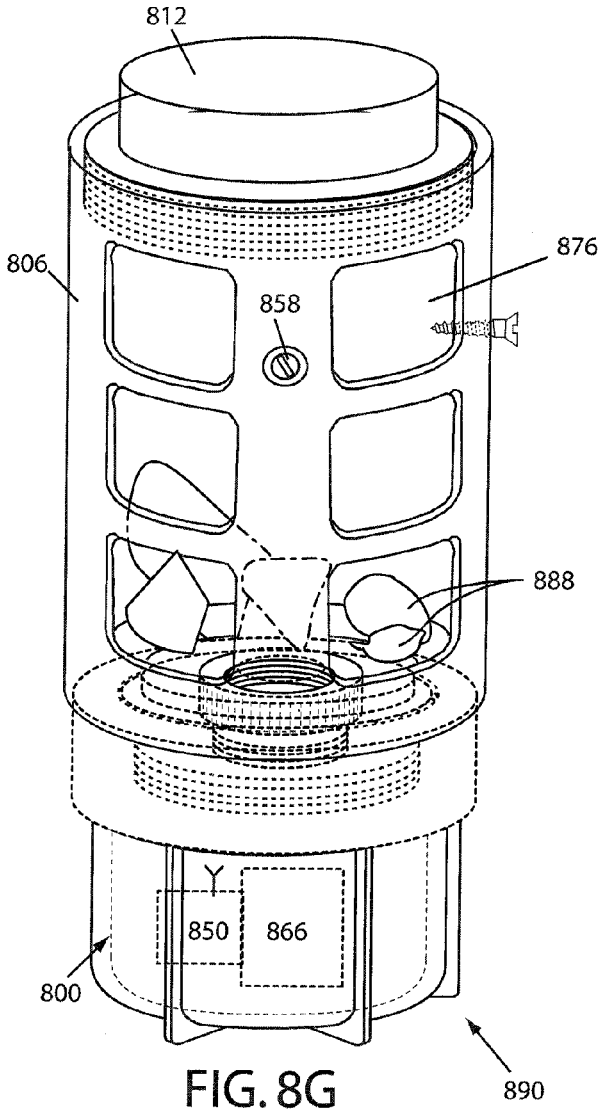

As shown in FIGS. 8D-8F, the NPED 800 may be fired to release compressed gas or other propellant from the NPED 800 to into the soda bottle 106 to rupture the bottle and produce a loud report and expel an expulsion substance through the windows 876. The housing 806 helps prevent fragments of the soda bottle from being ejected from the rupture and causing injury. The housing may be made of a material that can withstand repeated ruptures of the soda bottle 106, and sized to accommodate a standard soda bottle. In the exemplary embodiment shown in FIG. 8A, the housing is about 10.25 inches in length with a diameter of about 5.25 inches. The score lines help control the rupture of the bottle into larger pieces that are contained within the housing.

This socket system eliminates some of the problems associated with threading a bottle into a coupler, such as the inability to couple with bottles of unusual neck sizes, non-standard threads, or lack of threads. Because the soda bottle 106 is not threadably attached to the socket, its remnants 888 are easily removed after firing. For example, a user can simply remove the end cap 812 and remove the bottle fragments. This allows for the use of a wide variety of bottles that may have different threads or neck sizes.

The present invention thus provides a NPED that is adapted for use with a soda bottle or other readily available off-the-shelf container. The present invention also provides a NPED that provides both a loud report and a visual cue, and that is safe, inexpensive in both purchase price and operation, and reliable. The present invention also provides a NPED that can be quickly rearmed and that does not require specialized containers that make both re-supplying and re-arming more difficult. The NPED of the present invention provides a loud report at a low pressure. The present invention also provides a NPED in which a spent rupturable container is easily removed. The present invention also provides an NPED that is adapted for using both off-the-shelf containers and specialized rupturable devices. The present invention also provides a NPED that can is easily scalable to provide different magnitude reports by simply changing the size of the off-the-shelf rupturable containers.

The above-described and illustrated embodiments of the present invention are examples of implementations set forth for a clear understanding of the principles of the invention. Variations and modifications may be made to the above-described embodiments, and the embodiments may be combined, without departing from the scope of the following claims. It should be recognized that elements of the exemplary embodiments may be altered by persons skilled in the art without departing from the spirit and scope of the invention. For example, although in the exemplary embodiments the propellant was in the form of a compressed $CO_2$ gas, other propellants could be used, such as by way of example and not limitation, other fluids, gases or solids, such as nitrogen. In addition, while the pressure chamber is shown in some embodiments as a $CO_2$ cartridge various sized pressure chambers could be used that provide sufficient force to rupture the rupturable container.

The invention claimed is:

1. A system for simulating an explosion, comprising:

a non-pyrotechnic explosion device (NPED) comprising, a pressure chamber for releasably storing a propellant and an outlet port to allow the flow of the propellant when released from the pressure chamber;

a coupler configured to couple a rupturable container to the outlet port of the NPED to establish a flow path between the NPED and the rupturable container to rupture the rupturable container when the propellant is released from the pressure chamber, wherein the coupler is configured to couple the rupturable container to the outlet port of the expulsion substance container to provide a flow path between the expulsion substance container and the rupturable container; and an expulsive substance container configured to hold an expulsion substance and receive the propellant released from the pressure chamber, the expulsion substance container having an outlet port.

2. The apparatus of claim 1, further comprising a rupturable container coupled to the NPED by the coupler.

3. The apparatus of claim 2, wherein the rupturable container comprises a polyethylene terphthalate (PRT) container.

4. The apparatus of claim 2, wherein the rupturable container comprises a soda bottle.

5. The apparatus of claim 1, further comprising an actuator configured to release the propellant from the pressure chamber.

6. The apparatus of claim 1, wherein the pressure chamber is a $CO_2$ cylinder.

7. An apparatus for coupling a rupturable container to a non-pyrotechnic explosion device (NPED), comprising:

a coupler configured to removably couple a rupturable container to an outlet port of a non-pyrotechnic explosion device;

a housing configured to enclose the rupturable container therein; and wherein the coupler has a bore to establish a flow path between the NPED and a rupturable container.

8. The apparatus of claim 7, wherein the coupler is configured to engage threads of the rupturable container.

9. The apparatus of claim 7, wherein the coupler comprises a socket configured to receive a neck of the rupturable container.

10. The apparatus of claim 7, wherein the housing has a window to allow expulsion of an expulsion substance therethrough.

11. The apparatus of claim 7, further comprising and end cap removably attached to the housing to allow insertion of the rupturable container into the housing.

12. The apparatus of claim 11, wherein the end cap is configure to force a neck of the rupturable container into the socket.

13. The apparatus of claim 7, further comprising scoring means for scoring the bottle to assist in rupturing the bottle when the bottle is filled with the propellant upon release from the pressure chamber.

14. The apparatus of claim 13, wherein the scoring means comprise a screw penetrating the housing.

15. The apparatus of claim 7, wherein the coupler comprises a hardened-shell cap having a first threaded opening adapted for engagement with the threads of a soda bottle.

16. The apparatus of claim 15 further comprising a plug for plugging the bore of the coupler to seal the coupler.

17. The apparatus of claim 16, further comprising a soda bottle coupled to the coupler.

18. The apparatus of claim 17, further comprising:

a soda bottle coupled to the coupler; and an expulsions substance provided within the soda bottle.

19. The apparatus of claim 18, further comprising:

a plug sealing the bore of the coupler.

* * * * *